United States Patent [19]

Denboer

[11] Patent Number: 4,876,826

[45] Date of Patent: Oct. 31, 1989

[54] GRINDING AND POLISHING APPARATUS

[76] Inventor: Anthony J. Denboer, 8130 N. 17th Dr., Phoenix, Ariz. 85021

[21] Appl. No.: 246,404

[22] Filed: Sep. 19, 1988

[51] Int. Cl.[4] ..... B24B 7/00

[52] U.S. Cl. ..... 51/125; 51/216 R; 269/91

[58] Field of Search ..... 51/125, 125.5, 131.5, 51/216 R, 216 LP; 269/91, 92

[56] References Cited

U.S. PATENT DOCUMENTS

| | | | |
|---|---|---|---|
| 2,372,688 | 5/1945 | Spina | 51/125 |
| 3,078,088 | 2/1963 | Einsiedler | 269/91 |
| 4,625,460 | 12/1986 | Burgess et al. | 51/125 |
| 4,626,299 | 12/1986 | Knight et al. | 82/32 |

*Primary Examiner*—James G. Smith
*Assistant Examiner*—Jack W. Lavinder
*Attorney, Agent, or Firm*—H. Gordon Shields

[57] ABSTRACT

Grinding and polishing apparatus includes a block having a paddle to which an element to be ground and polished is secured, and the paddle is removably secured to the block. The block includes angular faces to allow the block to be brought into relatively close proximity to a viewing element, such as an optical microscope. The block also includes leveling elements for adjusting the orientation of the paddle and of the element to be ground and polished as secured to the paddle, and an adjustable element for varying the pressure of the element being ground and polished against an abrasive element. A removable paddle is secured to the block, and the element to be ground and polished is secured to the paddle. The apparatus also includes holding elements for holding a plurality of blocks on an abrasive element.

21 Claims, 2 Drawing Sheets

FIG. 7
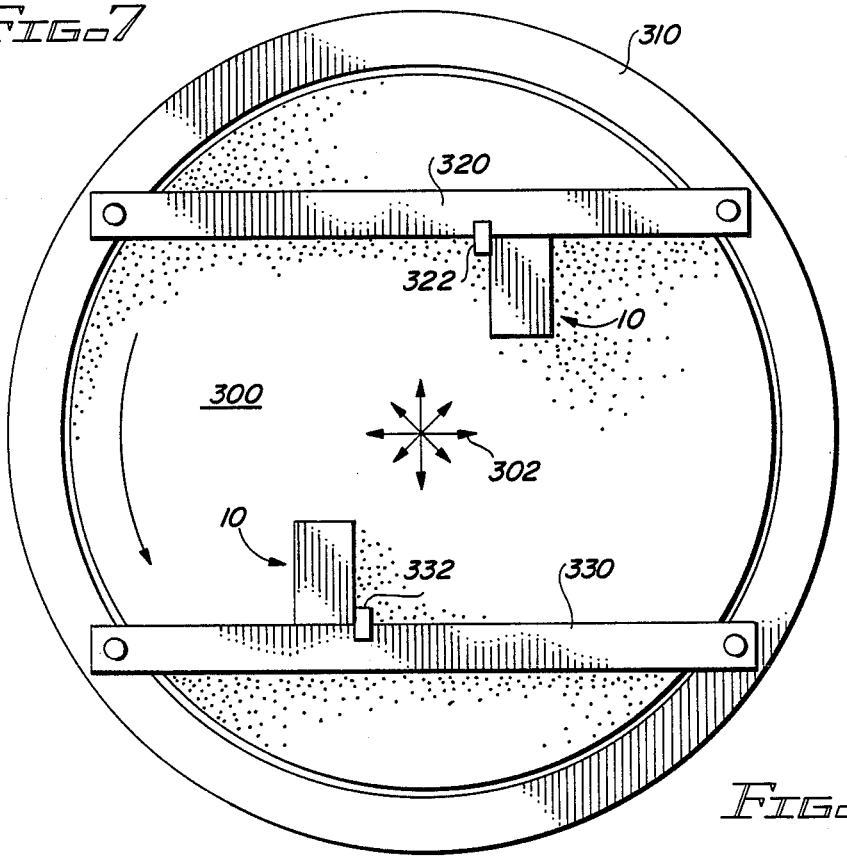
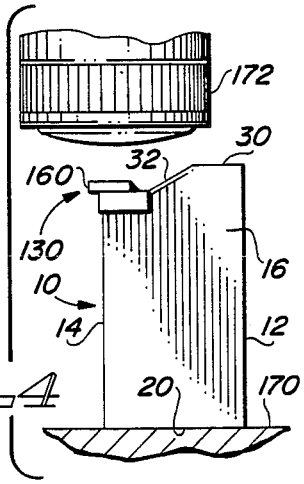
FIG. 4
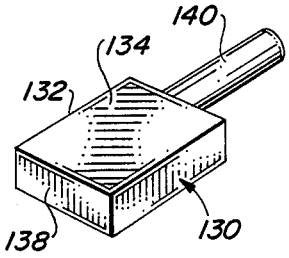
FIG. 3
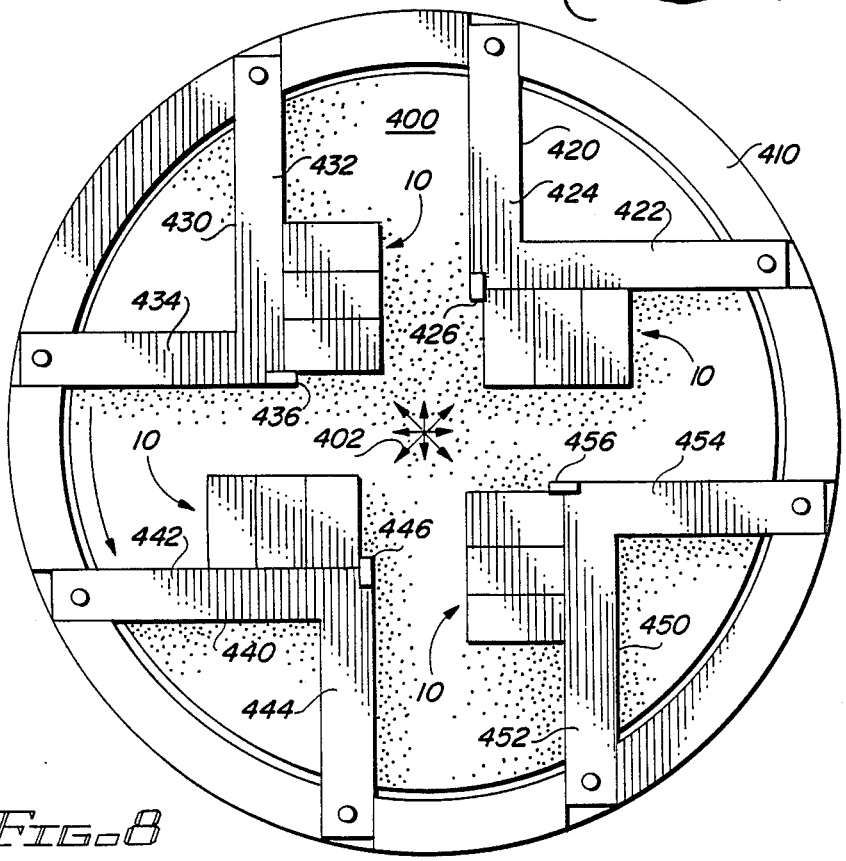
FIG. 8

GRINDING AND POLISHING APPARATUS

BACKGROUND OF THE INVENTION

1. Field of the Invention

This invention relates to grinding and polishing apparatus, and, more particularly, to grinding and polishing apparatus for electronic elements, such as integrated circuits.

2. Description of the Prior Art

Prior art grinding and polishing apparatus, such as typically used for lapping integrated circuit elements, generally includes a block to which an integrated circuit is secured. The block, with the integrated circuit secured to it, is then placed on a lapping wheel. As the wheel rotates, the integrated circuit is ground and polished, or lapped. Obviously, the lapping wheel includes an abrasive surface which provides the grinding and polishing (lapping) action. An appropriate lubricant, such as water, is typically sprayed or dropped onto the lapping wheel.

The lapping block, with the IC (integrated circuit) secured thereto, is held in place on the wheel by some type of restraint, such as a cross bar or the like. In actuality, several generally parallel and/or perpendicular bars may be disposed across a lapping wheel and a plurality of lapping blocks may be supported by the bars.

Prior art lapping blocks generally are not adjustable with respect to the lapping wheel. Accordingly, the surface to be lapped on the IC is dependent on the orientation of the IC on the lapping block. And, once the IC is secured to the block, the lapping surface is determined and cannot be changed without removing and reattaching the IC to the block.

After lapping, the ICs are generally examined under a microscope of some type, often an optical microscope. Due to the focal length of such instruments, the subject must be relatively close to the microscope. Typically, an IC must be removed from a lapping block in order to be completely and thoroughly examined in two axes under a microscope due to the inability of getting the IC close enough to the microscope while the IC is mounted on the block.

The apparatus of the present invention overcomes the problems of the prior art by providing a lapping block having a holding or mounting element for holding an integrated circuit to a block and by having leveling elements in the block to adjust the orientation of the block, and accordingly the orientation of the IC, with respect to the lapping wheel. The apparatus of the present invention also provides for the easy removal and replacement of the IC for examination by both optical and SEM apparatus and without demounting the IC.

SUMMARY OF THE INVENTION

The invention described and claimed herein includes polishing and grinding apparatus including a block having a removable paddle to which an element to be ground and polished (lapped), such as an integrated circuit, may be attached, and leveling elements to adjust the orientation of the lapping block, and accordingly of the element to be ground and polished (or lapped), with respect to an abrasive surface on which the block is disposed for grinding purposes. A pressure adjusting screw extends through the block to adjust the pressure of the element being ground and/or polished and/or lapped against the abrasive surface.

Among the objects of the present invention are the following:

To provide new and useful lapping apparatus;

To provide new and useful grinding and polishing apparatus;

To provide new and useful lapping apparatus having a lapping block;

To provide new and useful lapping apparatus including an element removably securable to a lapping block for holding an element to be lapped;

To provide new and useful apparatus for examining an element in two axes without demounting the element;

To provide new and useful apparatus for holding a sample to be examined in a scanning electron microscope without demounting the sample;

To provide new and useful holding apparatus for holding a plurality of lapping blocks on an abrasive wheel;

To provide new and useful lapping apparatus having a lapping block and elements for adjusting the orientation of the block relative to a lapping wheel; and To provide new and useful lapping apparatus including an adjustable element for adjusting the pressure of a subject being lapped against a lapping wheel.

BRIEF DESCRIPTION OF THE DRAWING

FIG. 3 is a perspective view of a portion of the apparatus of the present invention.

FIG. 4 is a side view illustrating one feature of the apparatus of the present invention in an examination environment.

FIG. 7 is a top view illustrating the apparatus of the present invention in a use environment.

FIG. 8 is a top view illustrating the apparatus of the present invention in an alternate embodiment from that shown in FIG. 7.

DESCRIPTION OF THE PREFERRED EMBODIMENT

Figure 1:
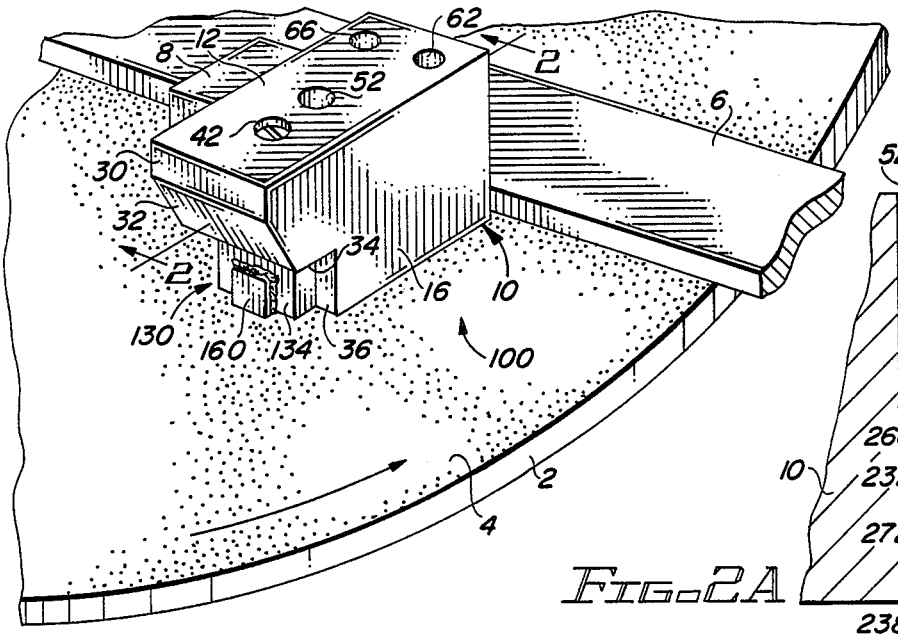
FIG. 1 is a perspective view of the apparatus of the present invention in its use environment.

FIG. 1 is a perspective view of grinding and polishing or lapping apparatus 100 of the present invention disposed on an abrasive wheel 2 for grinding and polishing, or lapping, purposes. For convenience hereinafter, the prefix "grinding and polishing or lapping" will be omitted. The apparatus 100 includes a grinding and polishing or lapping (hereinafter omitted) block 10 and a paddle 130. The block 10 is disposed against a holding or support element or bar 6, which is disposed across the wheel 2. A stop element or block 8 is secured to the bar 6. The support element or bar 6 and the stop block 8 prevent the block 10 from moving as the wheel rotates.

The wheel 2 includes an abrasive surface 4. The bar 6 is slightly above the surface 4 of the wheel 2. A large arrow in FIG. 1 indicates the direction of rotation of the wheel 2. The paddle 130 is secured to the block 10. A sample to be ground and polished (lapped) and examined, such as an integrated circuit (IC) die 160, is secured to the paddle 130 and is being lapped (or ground and polished) by the abrasive wheel 2.

Figure 2A:
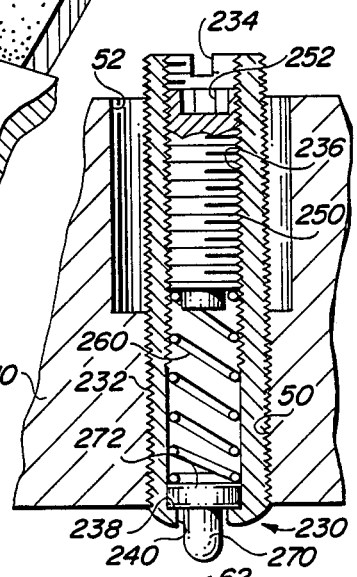
FIG. 2A is a view in partial section of a an alternate embodiment of a portion of the apparatus of the present invention.
Figure 2:
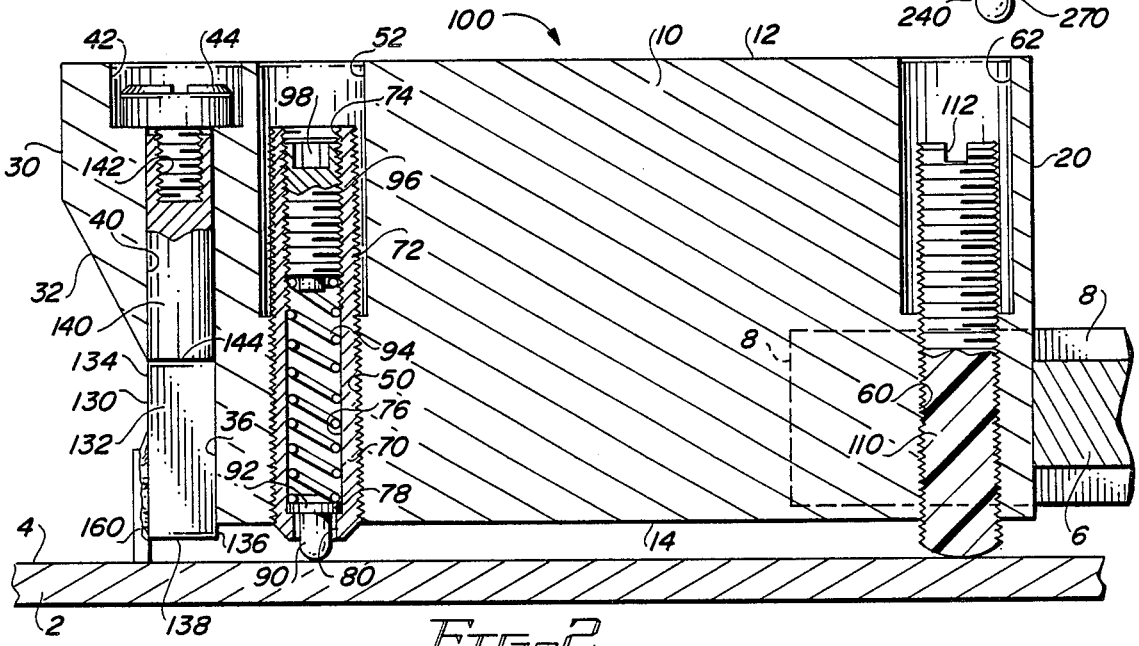
FIG. 2 is a view in partial section taken generally along line 2—2 of FIG. 1.

FIG. 2 is a view in partial section of the block 10 taken generally along line 2—2 of FIG. 1. FIG. 3 is a perspective view of the paddle 130 removed from the block 10.

For the following discussion, reference will generally be made to FIGS. 1, 2, and 3.

The block 10 is generally a rectangularly shaped element, but with specific angular features. The block 10 includes a top surface 12 and a bottom surface 14. The surfaces 12 and 14 are generally parallel to each other. The block 10 also includes a pair of lateral side surfaces, of which a side surface 16 is shown in FIG. 1. The block 10 also includes a back or rear side surface 20. The rear surface 20 is substantially perpendicular to the surfaces 12 and 14.

As discussed thus far, the block 10 has been generally rectangular. However, the front of the block 10 is not a single surface. Rather, the front of the block 10 includes a top front surface 30, which extends from the top surface 12 a relatively short distance. From the surface 30, remote from the surface 12, there is a sloping front surface 32. The sloping surface 32 extends downwardly and inwardly towards the body of the block 10. Extending upwardly from the bottom surface 14 is a bottom front surface 36. The surface 36 is generally parallel to the surfaces 20 and 30 and generally perpendicular to the surfaces 12 and 14.

Between the surface 36 and the surface 32 is a shoulder 34. The shoulder 34 may be referred to as a paddle shoulder because the paddle 130 is disposed against it. The paddle shoulder 34 is generally parallel to the surfaces 12 and 14.

Extending inwardly from the shoulder 34, and located generally at the midpoint of the shoulder 34, or about half way between the lateral side surfaces of the block 10, is a paddle bore 40. A counterbore 42 extends downwardly or inwardly from the top surface 12, coaxially aligned with the bore 40. A paddle screw 44 extends into the counterbore 42 and into the bore 40, as will be discussed below.

A second bore 50 extends upwardly from the surface 14. The bore 50 is threaded. A second counterbore 52 extends downwardly from the surface 12 and is coaxially aligned with the bore 50. The aligned bores 50 and 52 extend fully through the block 10 between the surfaces 12 and 14.

A spring plunger or pressure screw 70 is disposed in the bore 50 and in the counterbore 52. The screw 70 includes external threads 72 to mate with the internal threads of the bore 50.

The screw 70 also includes an internally threaded upper bore 74 which receives a set screw 96. Coaxially aligned with the threaded bore 74 is a lower bore 76. At the bottom of the bore 76 is a shoulder 78. The shoulder 78 extends radially inwardly. From the shoulder 78, an exit bore 80 extends downwardly to the bottom of the screw 70.

A plunger or pin 90 is disposed in the bore 80. A flange 92 of the pin or plunger 90 is disposed in the bore 76 and rests on the shoulder 78. The plunger 90 is biased by a compression spring 94 within the bore 76. The spring 94 extends between the plunger 90 and the set screw 96. The plunger 90 extends outwardly from the block 10 and is disposed against the surface 4 of the wheel 2. The plunger 90 is, of course, made of appropriate material to minimize its wear against the wheel 2. Preferably, a material such as "Teflon" polytetrafluoroethylene is used.

The set screw 96 includes a socket 98 which receives an allen wrench to allow the screws 70 and 96 to be positioned as desired in the bore 74 to adjust the height of the screw 70 with respect to the block 10.

Rearwardly from the bores 40, 42 and 50, 52, and generally adjacent to the rear face 20, are a pair of bores which receive levelling screws. The levelling screw bores include a threaded bore 60, which extends upwardly from the bottom surface 14, and an aligned counterbore 62. A levelling screw 110 is disposed in the aligned bores 60 and 62. The screw 110 includes a slot or socket 112 for adjusting the screw 110 in the bore 60.

The levelling screw 110 extends downwardly from the surface 14, and thus out of the block 60. The screw 110 is preferably made of the same material as the plunger 90.

Generally parallel to the bores 60 and 62 is another bore and counterbore, of which a counterbore 66, is shown in FIG. 1. The second bore and counterbore also receive a levelling screw, substantially identical to the screw 110. The counterbores 62 and 66, and of course their coaxial bores, are spaced apart from each other and are disposed inwardly from the rear or back side 20 and inwardly from their respectively adjacent lateral sides, as shown in FIG. 1.

By adjusting the levelling screws, of which only the screw 110 is shown, the block 10, with the paddle 130 and the die 160, may be adjusted to a level orientation with respect to the wheel 2 and its top surface 4.

Referring generally to FIGS. 1 and 2, it will be understood that by adjusting the screw 70 at the front of the block 10, the front of the block 10 may be raised and lowered, as discussed above. This comprises the adjusting of the block 10 in one plane. By adjusting levelling screw 110 and its companion screw (not shown), the block 10 may be adjusted in another plane. Thus, the three screws comprise elements for levelling and adjusting the block 10 in the two planes.

Figure 5:
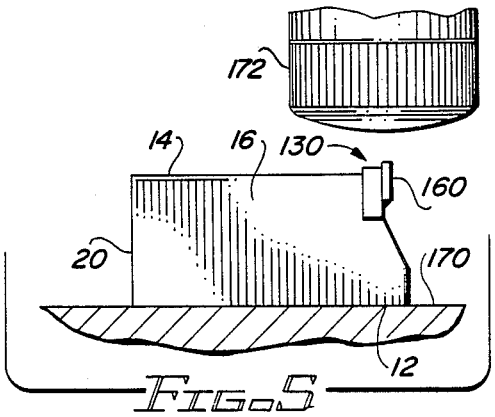
FIG. 5 is a side view illustrating another feature of the apparatus of the present invention in the environment of FIG. 4.

The paddle 130, best shown in FIG. 3, includes a generally rectangular block 132. The block 132 includes a pair of faces 134 and 136 which are substantially parallel to each other. The face 134 is the top face and the face 136 is the bottom face. The IC die 160 is appropriately secured, as with wax, to any desired surface, typically to the surface 134 or its opposite or parallel side or surface. The securing of the IC to a surface, such as the surface 134, is well known and understood in the art. The IC 160 extends outwardly beyond a front end face 138 of the block 132. The bottom face 136 is disposed on the face 36 of the block 10. As shown in FIGS. 2, 4, and 5, the block 132 preferably extends slightly outwardly beyond the bottom surface 14 of the block 10.

Extending outwardly from a rear end face 144 of the block 132 is a post 140. The post 140 includes a threaded bore 142 which receives the threaded shank of the screw 44. The post 140 extends into the bore 40 to secure the paddle to the block 10. The thickness or height of the block 132 is substantially the same as the height of the shoulder 34. The length of the block 132 is slightly longer than the length of the face 36. As indicated above, the IC 160 extends outwardly or downwardly beyond the outer or front end face 138 of the block 132 of the paddle 130. The rear end face 144 is disposed against the shoulder 34 when the paddle 130 is secured to the block 10.

FIG. 2A is a side view in partial section of an alternate embodiment of the pressure screw 70, illustrating an adjusting screw 230. The screw 230 includes external threads 232. The threads 232 mate with the threads of the bore 50.

At the top of the screw 230 is a diametrically extending slot, or pair of slots, 234. The slots 234 extend on opposite sides of an internally threaded and longitudinally extending bore 236. At the bottom of the bore 236 is a radially inwardly extending shoulder 238. The shoulder 238 terminates at an exit bore 240.

Disposed within the bore 236 is a set screw 250. The set screw 250 includes a socket 252 which receives a wrench (not shown) for adjusting the location of the set screw 250 in the bore 236. The screw 250 bears against a compression spring 260. The spring 260 in turn bears against and biases a plunger or pin 270. The pin or plunger 270 is substantially identical to the plunger 90, discussed above.

The plunger 270 extends through the exit bore 240. The plunger 270 includes a flange 272 which is disposed on the shoulder 238.

The purpose of the screw 230 is similar to that of the screw 70, discussed above. However, screw 230 provides an adjustability that the screw 70 does not provide. In addition to adjusting the pressure of the IC 160 against the surface 4 of the wheel 2, by bottoming out the spring 260 by the screw 250 and then by adjusting the location of the screw 230 with respect to the block 10, the height of the block 10 with respect to the wheel 2 may be varied. In turn, this may be used to limit the amount of grinding and polishing (or lapping) that may occur on the IC 160.

FIG. 4 is a side view of the block 10 disposed on a viewing stage 170 of an optical microscope 172. The block 10 is disposed in its vertical position, resting on the rear surface 20. The top or one axis, of the IC 160 is being viewed. The slant surface 32 allows the microscope 172 to be positioned extremely close to the IC 160.

FIG. 5 is a side view of the block 10 disposed on the viewing stage 170 of the microscope 172. In FIG. 5, the block 10 is disposed on its top surface 12 to allow the viewing of the IC 160 on its end or second axis. The IC 160 is being viewed in FIG. 5 on the surface of the IC that was lapped.

FIGS. 4 and 5 illustrate that the block 10 allows the IC to be examined in two axes without removing the IC from the block 10, or from the paddle 130. The paddle 130 remains secured to the block 10 during the two axis examination by the optical microscope 172. Thus, the IC die 160 remains mounted on the paddle 130 and the paddle 130 remains secured to the block 10 during the two axis examinations. Demounting of the die 160 is accordingly not necessary for two axis examination. When the block 10 is returned to the lapping wheel 2 for further grinding and polishing, no adjustment of the die is required. The grinding and polishing (or lapping) operation continues from where it left off.

The examination illustrated in FIG. 4 shows where the lapping process is in terms of the length of the sample (die) 160. The examination illustrated in FIG. 5 really provides the information desired. However, to obtain maximum information, a scanning electron microscope is used to provide the high magnification required for complete examination.

Figure 6:
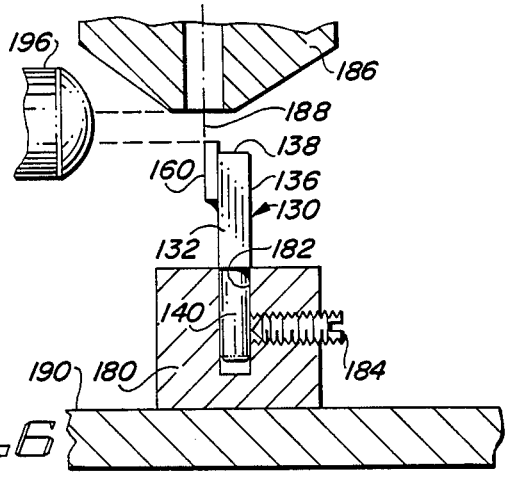
FIG. 6 is a schematic representation of the apparatus of the present invention in another examination environment.

FIG. 6 is a side view illustrating the paddle 130 removed from the block 10 and secured to a sample holder 180 for examination by a scanning electron microscope (SEM). The sample holder 180 includes a bore 182 which receives the post 140 of the paddle 130. The post 140 is held in place by a set screw 184. The sample holder 180 is disposed on an X-Y table 190 to allow the sample holder, and accordingly the IC 160, to be placed as desired beneath a column 186 of the SEM. An electron beam 188 is directed at the die 160 through the column 186. The electrons emitted by the target IC are directed to a detector 196. The operation of the SEM is well known and understood in the art.

It will be noted that when the SEM examination is completed, the paddle 130, with the IC 160 still secured thereto, may be replaced inthe block 10 to allow for the continued lapping of the IC. The IC remains in its original orientation with respect to the block 10 and with respect to the wheel 2 after the desired examinations have taken place, including after the SEM examination when the paddle 130 is reinstalled on the block 10. Due to dimensional constraints, as alluded to above. The paddle 130, when secured to the block 10 by the screw 44, has only a single orientation or disposition relative to the block 10. The IC 160 accordingly has only a single orientation or disposition with respect to the block 10, since it is fixed or secured to the paddle 130.

FIGS. 7 and 8 are top views of abrasive wheels (grinding and polishing or lapping wheels) usable with the apparatus of the present invention. In FIG. 7, a wheel 300 is shown. An appropriate lubricant 302, is sprayed or otherwise disposed onto the surface of the wheel 300 near the center of the wheel. The lubricant is carried outwardly, and over the surface of the wheel by centrifugal force. The lubricant 302 is schematically illustrated by the multi-axis arrows.

A splash ring 310 is mounted adjacent to and about the wheel 300. The ring 310 has an inner diameter slightly larger than the outer diameter of the wheel 300. A pair of holding or support bars 320 and 330 are secured to the ring 310. The bars 320 and 330 extend across the wheel 300. The bar 320 includes a stop block 322, and the bar 330 includes a stop block 332. A lapping block 10 is shown disposed against each of the stop blocks 322, 332 and the bars 320, 330 for lapping (grinding and polishing). If desired, another block or two may be disposed on or against each of the bars 320 and 330.

FIG. 8 illustrates an alternate bar arrangement which allows the placement of more blocks on a wheel than does the parallel bar arrangement of FIG. 7. In FIG. 8, a wheel 400 is shown, with lubricant 402 again schematically shown sprayed near the center of the wheel. A splash ring 410 is disposed about the wheel. The wheels and splash rings of FIGS. 7 and 8 are substantially identical. Similarly, the wheel 2, with its splash ring not shown, is also substantially identical to the illustrations of FIGS. 7 and 8.

Secured to the splash ring 410 are four holding or support bars 420, 430, 440, and 450. The bars each include two legs or arms at right angles to each other. The bar 420 includes arms 422 and 424. A stop block 426 is secured to the arm 422 at or adjacent to the juncture of the two arms. A plurality of lapping blocks 10 are disposed against the arm 422, and held against radial movement by centrifugal force by the stop block 426.

The bar 430 includes two arms 432 and 434. A stop block 436 is secured to the arm 432 at or near the juncture of the two arms. Another plurality of blocks 10 are disposed against the arm 432 and against the block 436.

The bars 440 and 450 similarly each include two arms, respectively arms 442 and 444, with a stop block 446 on the arm 442, and arms 452 and 454, with a stop block 456 on the arm 452, for the bars 440 and 450. Also similarly, a plurality of blocks 10 are disposed on the arms 442 and 452 and against the respective stop blocks 446 and 456.

Even if one or two more lapping blocks 10 is/are disposed against each bar 320 and 330 (of FIG. 7), the bar arrangement of FIG. 8 can obviously retain more grinding and polishing blocks 10 than can the bar arrangement of FIG. 7. Accordingly, the angled bars 420, 430, 440, and 450 provide additional advantages over the straight bars 320 and 330 for lapping (grinding and polishing) purposes.

The block 10 and the paddle 130 are both made of non-magnetic materials. The block 10 is preferably made of brass, and the paddle 130 is preferably made of stainless steel. Stainless steel is non-magnetic and is unaffected by etchants typically used on IC dice, and is accordingly preferred for the paddle.

A lapping set includes a block and at least a single paddle. If desired, a lapping set may include a plurality of paddles, interchangeable with each other to fit any block. Thus, several lapping sets may include a first plurality of lapping blocks and a second plurality of paddles, with the second plurality being greater in number than the first plurality.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Grinding and polishing apparatus for holding a sample to be ground and polished for examination on a grinding and polishing wheel, comprising, in combination:

block means, including a block having
- a top surface,
- a bottom surface,
- a rear surface,
- a top front surface adjacent to the top surface,
- a sloping surface adjacent to the top front surface,
- a bottom front surface adjacent to the bottom surface, and
- a shoulder extending between the sloping front surface and the bottom front surface;

paddle means removably securable to the block, including a paddle block to which the sample is secured; and means for securing the paddle means to the block against the shoulder in which the means for securing the paddle mean to the block includes a post extending outwardly from the paddle block and a paddle bore in the block for receiving the post, and means for securing the post in the paddle bore wherein the paddle bore extends into the block from the shoulder.

2. The apparatus of claim 1 in which the means for securing the post in the paddle bore includes a counterbore extending into the block from the top surface to, and coaxially with, the paddle bore, and screw means disposed in the counterbore and securable to the post.

3. The apparatus of claim 2 in which the means for securing the post in the paddle bore further includes an internally threaded bore in the post to which the screw means is secured.

4. The apparatus of claim 1 in which the block means further includes levelling and adjusting means for levelling the block in two planes.

5. The apparatus of claim 4 in which the levelling means includes a first levelling bore and a second levelling bore spaced apart from each other, and both extend into the block from the bottom surface, and a levelling element disposed in each levelling bore for levelling the block in one plane.

6. The apparatus of claim 5 in which the levelling elements of the levelling means comprise screws adjustably disposed in the levelling bores and extending outwardly from the bores and contacting the grinding and polishing wheel.

7. The apparatus of claim 6 in which the levelling means further includes counterbores extending into the block from the top surface to, and coaxially with, the first and second levelling bores through which the levelling screws are adjusted.

8. The apparatus of claim 5 in which the levelling means further includes screw means for levelling and adjusting the block in a second plane.

9. The apparatus of claim 1 in which the block means further includes pressure adjusting means for adjusting the pressure of the sample secured to the block relative to the grinding and polishing wheel.

10. The apparatus of claim 9 in which the pressure adjusting means includes
- a bore extending into the block from the bottom surface,
- screw means disposed in the bore,
- a spring bore in the screw means,
- a plunger disposed in and extending outwardly from the spring bore and contacting the grinding and polishing wheel, and
- means for adjustably biasing the plunger against the grinding and polishing wheel.

11. The apparatus of claim 10 in which the means for adjustably biasing the plunger includes a set screw adjustably disposed in the spring bore and a compression spring in the spring bore extending between the set screw and the plunger.

12. Grinding and polishing apparatus for holding, for grinding and polishing on a rotating polishing wheel, a sample to be examined by microscopic examination and by a scanning electron microscope, comprising, in combination:

block means disposed on the wheel, including a block having a front surface, a shoulder on the front surface, and a bore extending into the block from the shoulder; and paddle means to which the sample is secured for grinding and polishing and for examination, including
- a paddle block disposed on the front surface of the block and against the shoulder, and means for securing the paddle block to the block means, including a post extending into the bore, whereby the block means may be mounted for examination of the sample by a microscope and the paddle means and samples may be removed from the block means and inserted in a sample holder of a scanning electron microscope for examination and then the paddle means and sample may be returned to the block means for further grinding and polishing without removing the sample from the paddle means.

13. The apparatus of claim 12 in which the block means further includes levelling means for adjusting the level of the block on the wheel.

14. The apparatus of claim 12 in which the block means further includes adjustable means for adjusting the pressure of the sample being ground and polished on the wheel.

15. The apparatus of claim 12 in which the block means further includes adjustable limit means for limiting the amount of grinding and polishing of the sample by the wheel.

16. The apparatus of claim 12 in which the paddle means includes a generally rectangular paddle block having a top face, a bottom face, an end face, and a rear face generally parallel to the end face, and the rear face is disposed against the shoulder.

17. The apparatus of claim 16 in which the post extends outwardly from the rear face and into the bore.

18. Grinding and polishing apparatus for grinding and polishing a sample for examination, including a rotating abrasive wheel and a ring disposed about the wheel, the improvement comprising, in combination:

block means disposed on the wheel, including a block having a front surface;

means for securing the sample to the front surface of the block;

means for adjusting the level of the block and of the sample secured to the block in two planes; and bar means secured to the ring and disposed over the wheel for holding the block while the sample is ground and polished, including a first arm and a second arm, and the block is disposed against the first arm.

19. The apparatus of claim 18 in which the bar means includes a plurality of bar elements, and each bar element includes a first arm and a second arm, and each first arm is adapted to receive a plurality of blocks.

20. The apparatus of claim 18 in which the means for securing the sample to the front surface of the block includes a shoulder at the front surface and paddle means disposed on the front surface and against the shoulder, and the sample is secured to the paddle means for securing the sample to the block.

21. The apparatus of claim 20 in which the block means includes a bore extending into the block from the shoulder, and the paddle means includes a paddle block disposed on the front surface and against the shoulder and a post extending into the bore and secured to the block to secure the paddle block to the front surface and against the shoulder.

* * * * *